US006586083B1

(12) United States Patent
Weiss, Jr. et al.

(10) Patent No.: US 6,586,083 B1
(45) **Date of Patent: *Jul. 1, 2003**

(54) CAMOUFLAGED EROSION CONTROL MAT

(75) Inventors: Charles Arthur Weiss, Jr., Clinton, MS (US); Philip Garcin Malone, Vicksburg, MS (US); Kenneth George Hall, Vicksburg, MS (US); Bartley Patrick Durst, Vicksburg, MS (US)

(73) Assignee: U.S. Army Corps of Engineers as represented by the Secretary of the Army, Washington, DC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/017,728

(22) Filed: Feb. 3, 1998

(51) Int. Cl.[7] ..... B32B 25/02

(52) U.S. Cl. ..... 428/297.1; 428/196; 428/294.7; 442/327

(58) Field of Search ..... 428/175, 116, 428/180, 183, 212, 225, 257, 258, 259, 192, 196, 294.7, 297.1; 156/209, 290, 296, 305, 258

(56) References Cited

U.S. PATENT DOCUMENTS

| | | | | | |
|---|---|---|---|---|---|
| 4,158,932 | A | * | 6/1979 | Auriat | 47/9 |
| 4,407,606 | A | | 10/1983 | Larsen | 405/17 |
| 4,417,828 | A | | 11/1983 | de Winter | 405/17 |
| 4,521,131 | A | * | 6/1985 | Nandlal | 405/116 |
| 4,657,432 | A | | 4/1987 | Rentrop et al. | 405/24 |
| 4,657,433 | A | * | 4/1987 | Holmberg | 405/26 |
| 4,722,639 | A | * | 2/1988 | Alsop | 405/25 |
| 4,801,217 | A | | 1/1989 | Goldberg | 404/75 |
| 4,896,993 | A | * | 1/1990 | Bohnhoff | 404/33 |
| 5,358,356 | A | | 10/1994 | Romanek et al. | 405/16 |
| 5,364,206 | A | | 11/1994 | Marienfeld | 405/16 |
| 5,374,139 | A | | 12/1994 | Kugler | 405/129 |
| 5,421,123 | A | * | 6/1995 | Sakate et al. | |
| 5,459,181 | A | * | 10/1995 | West et al. | 524/35 |
| 5,575,588 | A | | 11/1996 | Nakamura | 405/18 |
| 5,616,399 | A | * | 4/1997 | Thelsen | 428/175 |
| 5,735,982 | A | * | 4/1998 | Prunty et al. | 156/62.2 |

* cited by examiner

*Primary Examiner*—Merrick Dixon
(74) *Attorney, Agent, or Firm*—John MacEvoy

(57) ABSTRACT

A mat for covering soil comprising a lower fabric layer, an upper fabric layer superimposed over the lower fabric layer, and a water absorbing material interposed between said lower fabric layer and upper fabric layer. The mat contains tubular segments containing fabric and hydraulically setting cement. The cover, when wetted, becomes ballasted by the absorbed water and the tubular elements harden to form rigid ribs that hold the mat in conformity with the surface of the underlying soil.

13 Claims, 2 Drawing Sheets

CAMOUFLAGED EROSION CONTROL MAT

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The present invention relates to camouflaged mats for concealment and erosion control and, more particularly, to a camouflaged mat formed with an absorbent medium for absorbing water and tubes containing fiber and hydraulic cement that will react and harden when wetted to form stiff members.

2. Brief Description of the Prior Art

Prior art methods of concealing fresh excavations would involve anchoring camouflage-patterned tarps or netting over the surface. Anchoring would be done by staking or weighting down the netting with sandbags or tying the tarp to soil anchors. Dust would have to be controlled by using a water spray or applying a dust palliative to the soil.

SUMMARY OF THE INVENTION

The present invention comprises a mat for covering soil which composes a lower fabric layer; an upper fabric layer superimposed over the lower fabric layer; and a water absorbing means interposed between said lower fabric means and upper fabric means. In a preferred embodiment, the mat has a rigid tubular support, is quilted and has a camouflaged upper surface.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts in the drawings and wherein.

DETAILED DESCRIPTION OF THE PREFERRED EMBODIMENT

The fabric mat of this invention is designed to cover and conceal bare earth produced during excavation. The mat consists of multiple fabric layers that hold a super-absorbing polymer in some sections of the mat and a mixture of fiber and hydraulic cement in other sections. Such suitable super-absorbing polymers would include cross-linked acrylamide potassium acrylate copolymers and cross-linked acrylamide sodium acrylate copolymers. One or more of such suitable super-absorbing polymers are commercially available from Stockhausen, Inc. (Greenboro, North Carolina). A suitable fiber is processed cotton, which is commercially available from Meade Corp. (Dayton, Ohio). The mat has a permeable or impermeable lower layer that rests against the soil surface. A layer of super-absorbing polymer and hydrophilic fiber such as cellulose fiber, treated wool fiber or treated synthetic fiber is held above this layer by a permeable camouflaged-patterned fabric that covers this absorber layer and is bonded, fused or sewn to the lower fabric layer in a quilt-like pattern. Quilting prevents the super-absorbing polymer and the fiber from shifting as the mat is moved. An array of tube-like compartments is provided between the two fabric layers. The compartments contain loosely rolled woven or non-woven fabric that contains hydraulically setting cement such as HYDROSTONE (U.S. Gypsum Co., Chicago, Ill.) in the rolled material. The array of tube-like compartments is designed to produce a bracing system that will prevent the mat from rolling up due to wind action. The cement is isolated by fabric tube walls or by permeable or semi-permeable membranes to prevent the high-ionic strength water from the cement from interacting with the super-absorbing gel. Some gels collapse and release water if solutions containing high concentrations of salts (such as calcium sulfate) are added to them. For this reason, the interface between the absorbent layer and the fabric tubes containing the cement should be composed of a fabric or membrane that will retard the movement of liquid between the fabric compartments containing the absorbent and the fabric tubes containing cement rolled in fabric.

Figure 1:
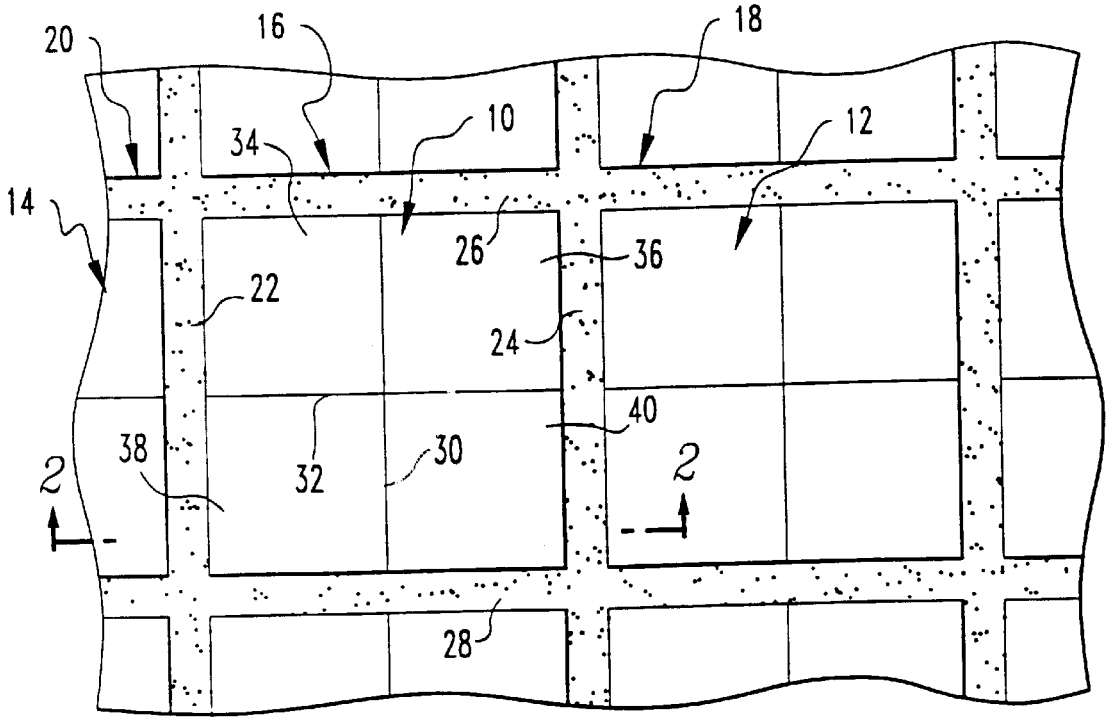
FIG. 1 is a top plan view of a mat representing a preferred embodiment of the present invention.

Referring to FIG. 1, the mat is segmented into a number of sections such as a first section shown generally at 10, a second section shown generally at 12 and a third section shown in fragment generally at 14. Each of these sections has a rigid peripheral support such as peripheral support 16 which supports the first section, peripheral support 18 which supports the second section and peripheral support 20 which supports the third section 14.

Figure 2:
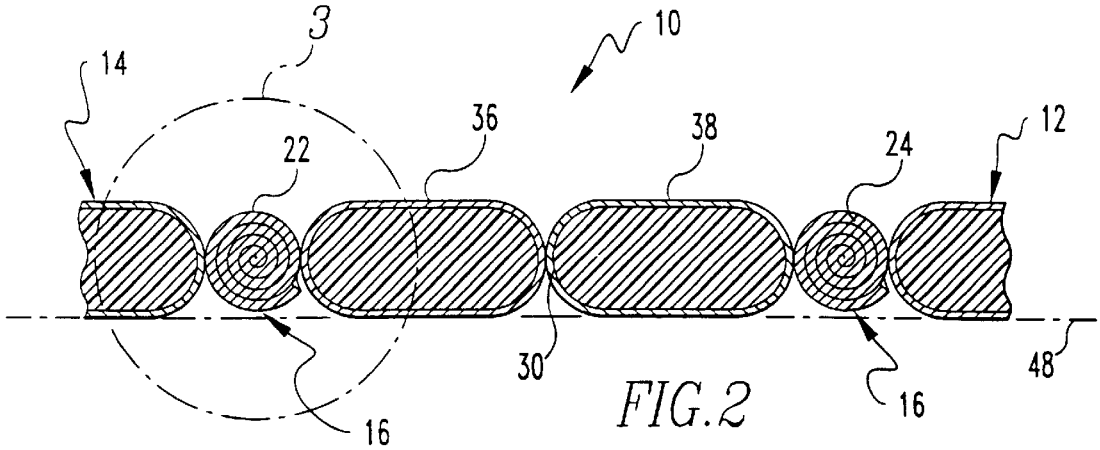
FIG. 2 is a cross sectional view through 2—2 in FIG. 1.
Figure 3:
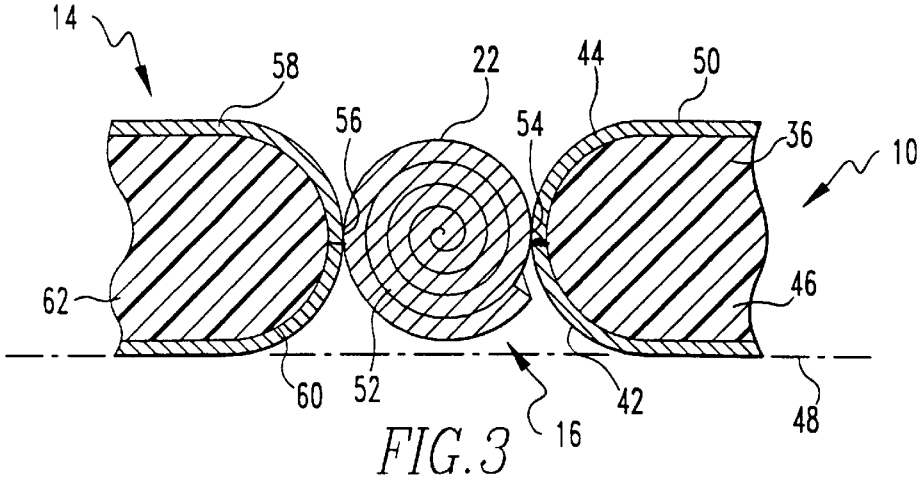
FIG. 3 is a detailed view of circle 3 in FIG. 2.

Each of the supports has a pair of perpendicular elements 22 and 24 as, for example, is shown in support 16. Each of these supports also has perpendicularly intersecting elements as at 26 and 28 as is, for example, shown in section 10. The sections also are quilted in section 10 along line 30 and perpendicular line 32. These quilt lines segment each of these sections into quadrants as at quadrants 34, 36, 38 and 40. The other sections 12 and 14 are similarly quilted. Referring particularly to FIGS. 2 and 3, section 10 of the mat includes a lower panel 42 and an upper panel 44 that is superimposed over the lower panel 42. Interposed between these are water-absorbing compositions that may be a super-absorbing polymer 48 such as AP-88 from Stockheusen Corp. (Greensboro, North Carolina). The lower panel 42 rests on the soil 48 that is to be covered by the mat. The upper panel has a top surface 50 that may be camouflaged. Referring particularly to FIG. 3, it will be seen that such as vertical element 22 is comprised of a cylindrical roll 52. In this roll a woven or non-woven fabric is spirally wound together with hydraulic cement to form the peripheral support 16. The cylindrical roll 52 is a single piece of fabric concentrically wound about itself. It is sewn to the adjacent sections 10 and 14 respectively at lines 54 and 56. It would, alternatively, be possible to form parts of these rolls making up the support 16 from either the lower panel 42 or the upper panel 44 of an adjoining section. Referring particularly to FIG. 3, it will be seen that section 14 also includes an upper panel 58 and a lower panel 60 with an intermediate super-absorbing polymer 62.

The mat is deployed by spreading the mat over bare soil and anchoring the mat, if needed, by means of loops of cord or fabric (not shown) sewn into the edges and corners of the mat. The loops are attached to stakes or auger-type soil anchors driven into the soil. Water is sprayed over the mat. The water passes through the permeable upper fabric layer and is collected by the super-absorbent polymer and fibrous cellulose absorber. The water infiltrating the tops of the fabric tubes wets the rolls made of fabric and hydraulically setting cement. The cement hydrates and hardens to produce rigid "plaster cast-like" braces in the mat. The super-absorbent polymer and fiber absorbent will absorb water and gain weight. The mat becomes heavily ballasted and contains rigid members that resist rolling or moving. The advantages of this mat are most evident in situations where the mat covers uneven ground and any lateral movement requires that the mat be lifted. The wetted polymer absorbent can produce a gel-like material that contains up to 300 time the weight of the polymer in the weight of water.

The absorbent is dyed to a color similar to a color on the upper surface so that any damage to the surface of the mat will be difficult to detect.

It will be appreciated that the mat of this invention has an advantage over conventional tarps or fabric systems in that each area of the mat takes on weight when water is sprayed over the mat. This effect is similar to the effect produced if a tarp system could be covered with ballasting rock. It will also be appreciated that the cemented rod-like braces, that form after the mat is wetted, resist any rolling of the mat and that the mat can be constructed from components that are generally regarded as safe for the environment. The mat can also be left in place after use to assist in revegetation operations, and the mat can be constructed with a color-pattern and fabric "garnish" that will assist in concealing fortifications or blending erosion control measures into the background. The large water-holding storage capacity of the mat also makes it possible for the mat to reduce dust by creating a highly humid area across the ground surface.

Colored fabric can be added to the mat so that it can be used as an aerial recognition panel. The color of the top cover is carried through the entire thickness of the mat so that damage to the mat is difficult to detect.

The mat of this invention solves the problem of concealing excavations and bare soil in military maneuver and training areas. The mat can be saturated to the extent that the mat cannot be moved by the wind. The hardened rigid cement-and-fabric rods prevent the mat from rolling up and make the mat conform to uneven surfaces.

It will also be appreciated that the possible uses for the self-ballasting, self-bracing panel would include the fact that it is an easily deployed concealment system, a dust and erosion control mat and a signal panel deployment system. The mat may also be used in initial efforts at restoring ground cover or a false or decoy operating surface.

Those skilled in the art will also appreciate that a means has been provided for use of water absorbing media to produce ballast in a camouflage mat. A means has also been provided for using a fabric and cement rod to hold the mat down on an uneven surface.

The production of separated areas on the mat also provides a way of holding an absorbent material away from the cement and fabric rolls.

The combination of absorbent-type ballast, with stiffening rods of cloth and cement and conventional soil anchoring also provides a means for holding erosion-control mat in place.

The use of color through all parts of the mat is important so that damage is difficult to detect. The mat also provides a way of using a water absorbing media to control thermal infrared (IR) signatures. The use of water absorbing media also controls microwave and millimeter wave response.

While the present invention has been described in connection with the preferred embodiments of the various elements, it is to be understood that other similar embodiments may be used or modifications and additions may be made to the present described embodiment for performing the same function of the present invention without deviating therefrom. Therefore, the present invention should not be limited to any single embodiment, but rather construed in breadth and scope in accordance with the recitation of the appended claims.

What is claimed is:

1. A mat for covering soil comprising:

a lower fabric layer;

an upper fabric layer superimposed over the lower fabric layer; and a water absorbing means interposed between said lower fabric means and upper fabric means, wherein the mat has a peripheral support means which is a tubular roll of fabric with a water activated hydraulic cement hardening means.

2. The mat of claim 1 wherein the lower fabric layer is superimposed over the soil to be covered.

3. The mat of claim 2 wherein the lower fabric layer is water permeable.

4. The mat of claim 2 wherein the lower fabric layer is water impermeable.

5. The mat of claim 1 wherein the upper fabric layer is water permeable.

6. The mat of claim 1 wherein the water absorbing means is a polymeric water absorbing means.

7. The mat of claim 6 wherein the polymeric water absorbing means is selected from the group consisting cross-linked acrylamide potassium and acrylate copolymers and cross-linked acrylamide sodium acrylate copolymers.

8. The mat of claim 1 wherein the water absorbing means includes a hydrophillic fiber.

9. The mat of claim 8 wherein the hydrophillic fiber is selected from the group consisting cellulose fiber, wool fiber and synthetic fiber.

10. The mat of claim 1 wherein the upper layer has a top surface and said top surface is camouflaged.

11. The mat of claim 1 wherein the roll of fabric is comprised at least in part of the lower fabric layer.

12. The mat of claim 1 wherein the roll of fabric is comprised at least in part of the upper fabric layer.

13. The mat of claim 1 wherein the upper fabric layer is fixed to the lower fabric layer such that the mat is quilted.

* * * * *